United States Patent [19]

Freeman, Reginald E. et al.

[11] Patent Number: 4,491,441

[45] Date of Patent: Jan. 1, 1985

[54] SELF-ADVANCING SUPPORT AND CONTROL MEANS THEREFOR

[75] Inventors: Freeman, Reginald E., Upton-Upon-Severn; Alan J. Berry, Tewkesbury, both of England

[73] Assignee: Dowty Mining Equipment Limited, England

[21] Appl. No.: 541,557

[22] Filed: Oct. 13, 1983

[30] Foreign Application Priority Data

Oct. 29, 1982 [GB] United Kingdom ..... 8231047

[51] Int. Cl.[3] ..... E21D 23/00

[52] U.S. Cl. ..... 405/294; 405/291; 405/293

[58] Field of Search ..... 405/291–297, 405/302; 299/31, 33; 91/170 MP

[56] References Cited

U.S. PATENT DOCUMENTS 4,310,268 1/1982 Bower et al. ..... 405/294
4,386,878 6/1983 Martinko et al. ..... 405/296

FOREIGN PATENT DOCUMENTS 1037734 8/1966 United Kingdom ..... 405/294
2075584 5/1980 United Kingdom .
2074223 10/1981 United Kingdom ..... 405/293
2096680 10/1982 United Kingdom .

*Primary Examiner*—Dennis L. Taylor
*Attorney, Agent, or Firm*—Hayes, Davis & Soloway

[57] ABSTRACT

A self-advancing support, suitable for use in mines, includes a cantilever which is extendible and retractable with respect to a main portion of the support, and a sprag which is so mounted on said cantilever as to be extendible and retractable with respect thereto. Means are provided for advancing the support with respect to a mineral face and further means are provided for ensuring that during advance of the support the sprag is maintained in an extended, mineral-face-engaging, condition while the main portion is moved with respect to the cantilever in the direction towards the face, thereby reducing cantilever extension.

8 Claims, 3 Drawing Figures

SELF-ADVANCING SUPPORT AND CONTROL MEANS THEREFOR

Figure 1:
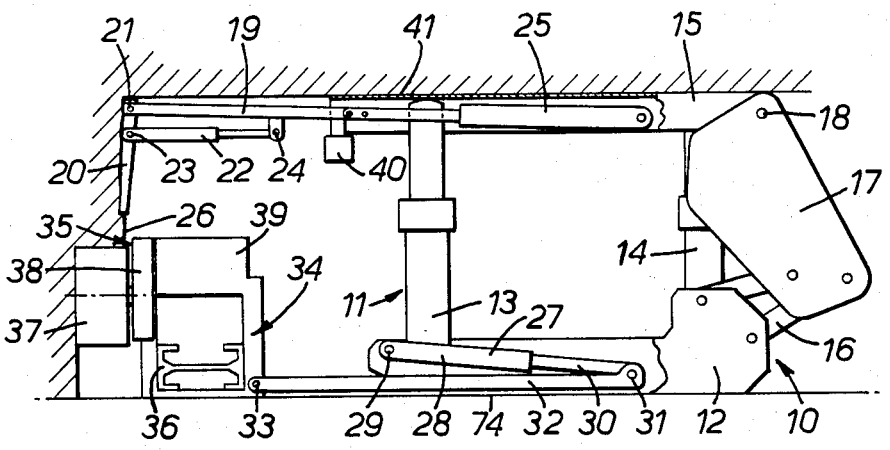

This invention relates to a self-advancing support and control means therefor suitable for use in mines in association with mineral cutting and conveyor equipment.

Hitherto, certain such supports have included a sprag mounted upon the free end of a cantilever, the cantilever being extendible and retractable with respect to the main part of the support. The sprag can be held against the substantially upright wall of the mineral face by suitable means, for example an hydraulically-operable ram. When a cutting machine moving on a conveyor which extends along the mineral face has passed the respective support thereby revealing a new upright wall forming the working face, it is necessary in customary manner to release the support from engagement with the mine roof and to advance it by suitable means towards the new wall. Before such advancing can take place it has been the practice to retract both the sprag and the cantilever and subsequently, following advancing of the support, to extend the sprag and cantilever respectively for engagement with the new upright wall and the adjacent part of the mine roof. The cantilever has itself been extended for example by an hydraulic ram and has been tilted into engagement with the roof by an hydraulically-operable capsule. The sprag has been pivotally-mounted on the cantilever and thus upon operation of its ram hinged forwardly into engagement with the upright wall.

This arrangement suffers from the disadvantage that during advance of the support the sprag is withdrawn from the face which is therefore left unsupported adjacent that support. Further, upon completion of support advance it is necessary to re-sequence the rams for effecting extension of the cantilever and sprag to their roof and wall supporting positions.

The invention as claimed is intended to provide a remedy. It solves the problem of how to design a self-advancing support suitable for use in mines in which there is no need to retract the sprag with respect to the cantilever, and the cantilever into the stationary main portion of the support, before support advance can take place.

According to this invention a self-advancing support, suitable for use in mines, includes a cantilever which is extendible and retractable with respect to a main portion of the support, a sprag which is so mounted on said cantilever as to be extendible and retractable with respect thereto, means for advancing the support with respect to a mineral face and means for ensuring that during advance of the support said sprag is maintained in an extended, mineral-face-engaging, condition while said main portion is moved with respect to said cantilever in the direction towards said face, thereby reducing cantilever extension.

Preferably, said sprag is pivotally-mounted upon the free end of said cantilever and is movable from its retracted to its extended condition, and vice versa, by a first fluid-pressure-operable ram suitably connected to the sprag and to the cantilever.

Preferably also, said cantilever is extendible and retractable with respect to a mine-roof-engageable canopy, forming part of said main portion, by a second fluid-pressure-operable ram housed within said canopy.

The means for advancing said support may comprise a third fluid-pressure-operable ram one element of which is connected to a mine-floor-engaging beam, forming another part of said main portion, and the other element of which is connected to one end of a relay bar, the other end of said relay bar being connected to conveyor equipment associated with the support and running along the length of said face.

Mineral cutting equipment is preferably mounted upon the conveyor equipment, so that as it is hauled along the conveyor equipment it can be caused to engage said face and to extract mineral material therefrom.

The first, second and third rams preferably form part of a fluid-pressure control circuit for said support, suitable control valve means being provided which are so operable that for advance of the support said first ram is hydraulically locked in an extended condition thereby to maintain said sprag in engagement with said face, the second ram is placed in communication with return or with low pressure, and the third ram is operable to move said main portion towards said face.

Preferably also said support includes a fluid-pressure-operable capsule operable to tilt said cantilever, when in an extended or extending condition, into load-supporting engagement with the mine roof.

The said canopy may be supported from said floor-engaging beam by a plurality of fluid-pressure-operable telescopic props.

Also according to this invention a support system, suitable for use in mines in association with conveyor equipment running along a mineral face, includes a series of self-advancing supports arranged in side-by-side relationship along the face and each support including a mine-floor-engaging beam, fluid-pressure-operable prop means mounted on said beam and supporting a roof-engageable canopy, a cantilever which is extendible and retractable with respect to the canopy, a sprag engageable with said face and so mounted on said cantilever as to be extendible and retractable with respect thereto, and an advancing ram connected between the support and the conveyor equipment for advancing the support with respect to said face, said system also including a source of fluid pressure, a fluid-pressure-operable ram for operating said sprag, a fluid-pressure-operable ram for operating said cantilever, and control valve means in communication with said source and in fluid circuit with said rams and said prop means, said control valve means being so operable that with said prop means released and thus said canopy released from engagement with said roof and with the advancing ram then energised for advance of the support towards said face the ram associated with said cantilever is so open to return or low pressure as to offer substantially no resistance to operation of said advancing ram, while the ram associated with said sprag is so energised as to maintain the sprag in an extended, mineral-face-engaging, condition.

The advantages offered by the invention are mainly that the sprag can, during advance of the support, remain in load-supporting engagement with an upright working face of the mine and as a result the risk of inadvertent collapse of that face, for example onto adjacent conveyor equipment, is substantially less.

Figure 2:
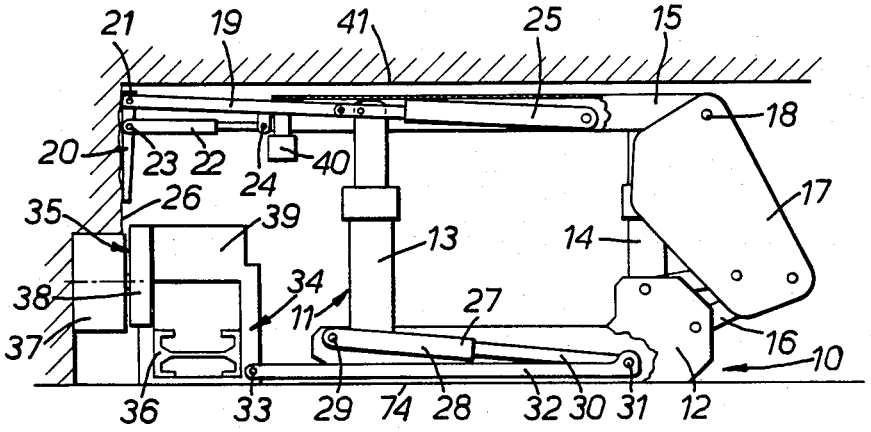
Figure 3:
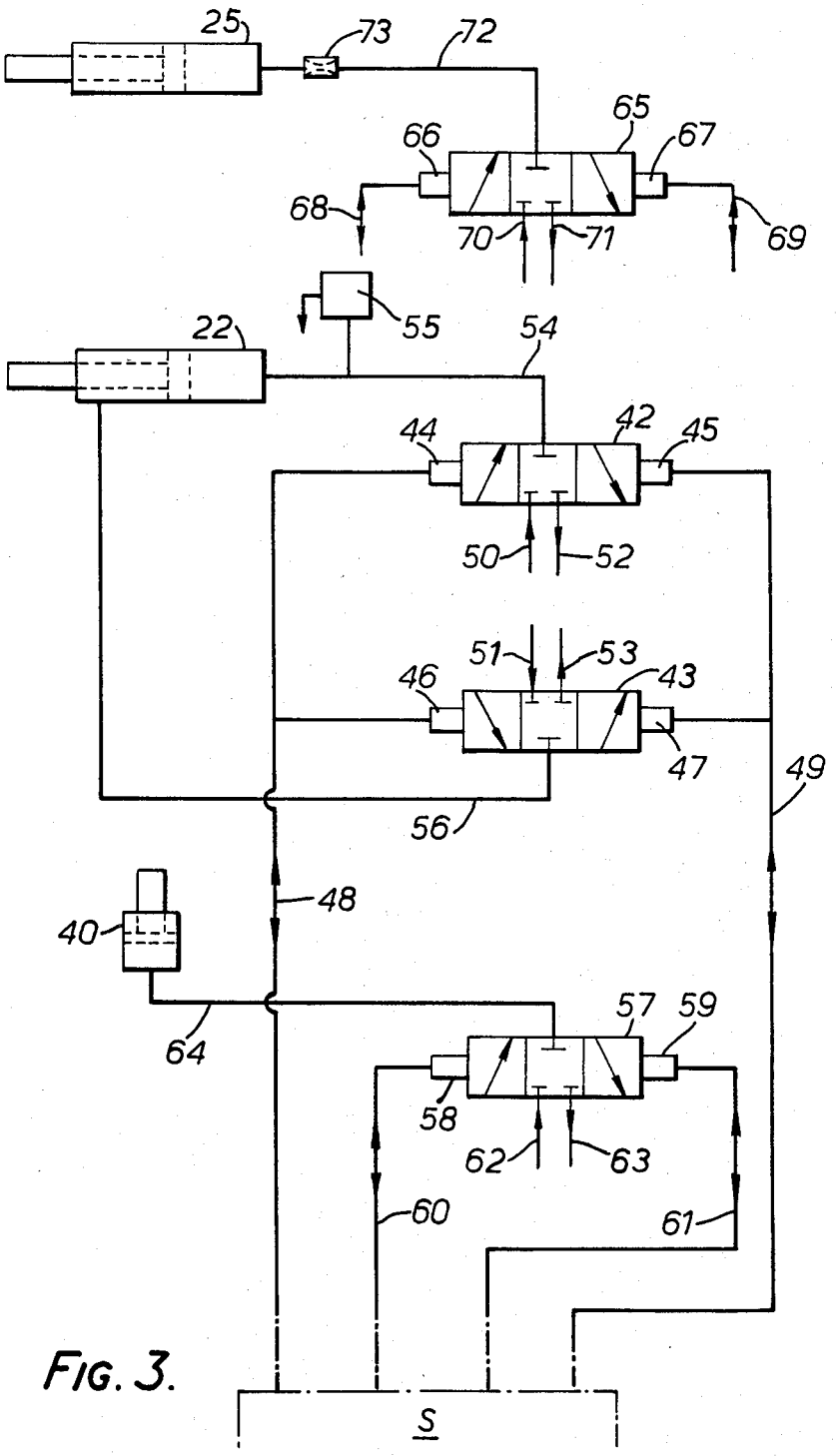

One way of carrying out the invention is described in detail below the reference to drawings which illustrate only one specific embodiment, in which:

FIG. 1 is a partly cut-away side elevation of a self-advancing support installed in a mine and associated with mineral cutting and conveying equipment, FIG. 2 is a side elevation similar to that of FIG. 1 but with the support released from the mine roof and in the process of being advanced, and FIG. 3 diagrammatically shows parts of an hydraulic circuit associated with the support shown in FIGS. 1 and 2.

The self-advancing support 10 shown in FIGS. 1 and 2 is of shield type, its main portion 11 including a mine-floor-engaging beam 12, two pairs 13, 14 of hydraulically-operable telescopic props mounted on the beam and a mine-roof-engageable canopy 15 supported by the props. A lemniscate linkage 16 provided on the rear end portion of the beam 12 supports a goaf shield 17 which is itself pivotally-connected at 18 to the rearward end portion of the canopy.

A cantilever 19 is carried by the canopy, being extendible and retractable with respect thereto and at its outer, forward, extremity carrying a sprag 20. The sprag is so pivotally-mounted at 21 upon the cantilever as to be extendible and retractable with respect thereto by a first hydraulically-operable telescopic ram 22 pivotally-connected at 23 to the sprag and at 24 to the cantilever. In its fully-retracted position, that is upon full contraction of the ram, the sprag is folded back under the cantilever so as to lie substantially parallel therewith.

The cantilever 19 is itself extendible and retractable with respect to the canopy 15 by a second hydraulically-operable telescopic ram 25 suitably mounted on the underside of the canopy.

Means for advancing the support 10 with respect to the mineral face 26 includes a third hydraulically-operable telescopic ram 27, the cylinder 28 of which is pivotally-connected at 29 to the beam 12 and the piston rod 30 of which is pivotally-connected at 31 to the rearward end of a relay bar 32. The forward end of the relay bar is pivotally-connected at 33 to conveyor equipment 34, of scraper-chain type, associated with the support 10 and running along the length of the mineral face 26.

Mineral cutting equipment 35 is mounted on the conveyor equipment and is arranged to be hauled along the aligned pans 36 of that equipment by suitable means (not shown). The cutting equipment includes cutter drums as at 37 each carried by an angularly adjustable ranging arm 38 mounted on the body 39 of the equipment.

Two hydraulically-operable capsules, one of which is shown at 40, are carried side-by-side on the underside of the forward end portion of the canopy 15. When pressurised these capsules tilt the cantilever upwardly into load-supporting engagement with the mine roof 41. The self-advancing support 10 is one of a series of similar supports arranged in side-by-side relationship along the mineral face 26.

FIG. 3 shows the circuit arrangements associated with the ram 22 for operating the sprag 20, with the ram 25 for operating the cantilever 19 and with the capsules 40 for tilting the cantilever. Two three-position control valves 42, 43 are arranged in circuit with the ram 22, each valve having fluid-pressure-operator means 44, 45; 46, 47 responsive to hydraulic pilot signals transmitted through either the pilot line 48 or the pilot line 49 from a suitable rotary selector valve (not shown). Whichever of the two lines 48, 49 is not so transmitting a pilot signal is open to return. Pressure lines 50, 51 are taken to the centre section of the valves 42, 43 and return lines 52, 53 are taken therefrom. A service line 54 is taken from the valve 42 to the right-hand side of the ram 22 and this line incorporates a yield valve 55. A service line 56 is taken from the valve 43 to the left-hand side of the ram 22.

A further three-position control valve 57 is arranged in circuit with the capsules 40 and has fluid-pressure-operator means 58, 59 to which pilot lines 60, 61 are taken. A pressure line 62 is taken to the centre section of this valve and a return line 63 is taken therefrom. A service line 64 is taken from the valve 57 to the capsules 40.

Another three-position control valve 65 is arranged in circuit with the ram 25 for operating the cantilever, this valve having fluid-pressure-operator means 66, 67. Hydraulic pilot signals can be transmitted to either of these means through lines 68 or 69 in dependence upon the setting of a suitable selector (not shown) for controlling operation of the cantilever. A pressure line 70 is taken to the centre section of the valve 65 and a return line 71 is taken therefrom. A service line 72 which is taken to the right-hand side of the ram 25 includes a restrictor 73.

Although not shown in the drawings suitable control valves and hydraulic circuits are provided in association with the advancing ram 27 and with the telescopic props 13, 14.

The hydraulic circuits above described are supplied with liquid under pressure adequate for the intended operation of the support from a source S comprising suitable pumping and reservoir means.

In operation, assuming the support 10 to be in the position shown in FIG. 1, that is with the canopy 15 in load-supporting engagement with the roof 41, the cantilever 19 fully extended and tilted upwardly against the roof by the capsules 40 and the sprag urged by the ram 22 into load-supporting engagement with the face 26, the extraction of the mineral material can take place along the length of the face by operation of the cutting equipment 35, the material extracted being carried away from the face by the conveyor equipment 34. In this condition of the support the ram 22 is hydraulically locked with the sprag 20 in load-supporting engagement with the face 26 and any movement of the sprag such as might be caused by movement of mineral material from the face is resisted by the yield valve 55. The ram 25 is also hydraulically locked on its full area side and any rearward movement of the cantilever is received on a suitable relief valve (not shown) provided in association with that ram. The capsules 40 are similarly held hydraulically locked and a suitable relief valve (also not shown) is similarly provided.

When it is required to advance the support towards the newly cut face 26, the control valves (not shown) associated with the props 13, 14 are operated as a first step in the support advance sequence so that the canopy 15 is lowered away from engagement with the mine roof 41. Simultaneously, the valves 42, 43 are caused by suitable operation of the rotary selector valve and consequent application of pilot signals to the means 45, 47 to move to the left away from their neutral positions so that the right-hand side of the ram 22 is placed in communication with return by way of lines 54, 52, and so that the left-hand side of that ram is placed in communication with return by way of lines 56, 53. This allows sprag 20 to fall freely to the vertical position as shown in FIG. 2. Simultaneously also, a pilot signal is applied to the means 59 and the valve 57 moves to the left away from its neutral position so that the capsules 40 are placed in communication with return by way of lines 64, 63.

When, as the second step in the support advance sequence, the appropriate control valves (not shown) are operated so that the advancing ram 27 is energised in its extending direction, a pilot signal is suitably transmitted to the means 67 of valve 65. As a result this valve is moved to the left so that the right-hand side of ram 25 associated with the cantilever 19 is placed in communication by way of the line 72, restrictor 73 and line 71 with return, or alternatively is placed in communication with a source of liquid at a suitable low pressure which, whilst being high enough to maintain a useful forward force on the sprag, is nevertheless low enough not to impede support advance seriously, and the sprag is held in supporting engagement with the face 26. As this occurs the rotary selector valve is operated to release the pilot signals applied to the means 45, 47 and the valves 42, 43 are spring-centred to the neutral positions. Hence the ram 22 is hydraulically locked to maintain the sprag in its face-supporting condition. With continued extension of the ram 27 the main portion 11 of the support advances towards the face 26 with the sprag and cantilever stationary and the canopy moving onto the cantilever, the amount by which the cantilever projects from the canopy thus being at least substantially reduced.

As the ram 27 reaches it fully extended condition the pilot signal to the means 67 is released so that the valve 65 is spring urged back to its neutral position and the ram 25 is then held in an hydraulically-locked condition.

During the advancing movement of the support the conveyor equipment is held fast with respect to the floor 74 by adjacent supports which are then not themselves undergoing advance. Additionally, hydraulically-operable staking means may be provided on the conveyor equipment in the vicinity of the pivotal connection 33 to provide for positive holding of the conveyor with respect to the ground at the forward end of the relay bar 32.

The third step in the support advance sequence is the setting of the telescopic props 13, 14 which is effected by suitable operation of their control valves (not shown). This causes re-engagement of the canopy 15 with the mine roof 41 and simultaneously a pilot signal is suitably applied to the means 58 of valve 57 to move that valve to the right so that pressure liquid passes through the lines 62, 64 to the capsules 40. Consequent extension of the capsules tilts the cantilever 19 so that its forward end portion is brought into load-supporting engagement with the roof 41.

When it is necessary to retract the sprag to allow the cutting equipment to pass that particular support for extracting mineral material from the face 26 in the vicinity of the sprag, valve 43 is caused to move to the right and valve 42 to the left resulting in contraction of the ram 22. It may be desirable to retract the sprag fully so that it folds back into a position substantially parallel to the canopy for this purpose. Thereafter, the sprag is re-extended by causing the valve 43 to move fully to the left and the valve 42 to the right. The cantilever 19 can be extended simultaneously by causing valve 65 to move to the right to effect extension of ram 25 appropriate to the required new face-supporting position of the sprag. The valves 42, 43, 65 are then permitted to return to their neutral positions so that the rams 22, 25 are hydraulically locked in their new positions. Thus the sprag 20 is removed from engagement with the face 26 for the shortest possible time and is then rapidly returned to its face-supporting position.

If operational conditions require it, the sprag can be fully or partially retracted whenever necessary simultaneously with suitably controlled full or partial retraction of the cantilever, but again can be rapidly returned to its supporting position. Also, if with the sprag extended conditions are such that adjustment in the setting of the sprag against the face 26 is necessary this can quickly be effected by suitably operating the valves 42, 43 for appropriate adjustment of the ram 22.

In conventional manner, when it is required to advance the conveyor equipment 34 the ram 27 is caused to contract and since the support 10 is then set fast against the floor 74 and roof 41 this movement is accordingly transmitted by the relay bar 32 to the conveyor equipment 34, the rams 27 of adjacent supports operating likewise, so that the equipment is bodily advanced as required.

By this invention therefore means are provided to ensure that the sprag 20 is maintained in positive load-supporting engagement with the face 26 during the advancing of the support, thus avoiding the undesirable situation, as hitherto was the case, of leaving the face unsupported during advance and hence susceptible to collapse. This is extremely advantageous, especially in mines where the mineral material being extracted is of a friable nature, for example where the material is lignite.

I claim:

1. A self-advancing support, suitable for use in mines, including a cantilever which is extendible and retractable with respect to a main portion of the support, a sprag which is so mounted on said cantilever as to be extendible and retractable with respect thereto, means for advancing the support with respect to a mineral face and means for ensuring that during advance of the support said sprag is maintained in an extended, mineral-face-engaging, condition while said main portion is moved with respect to said cantilever in the direction towards said face, thereby reducing cantilever extension.

2. A support as claimed in claim 1, in which said sprag is pivotally-mounted upon the free end of said cantilever and is movable from its retracted condition to its extended condition, and vice versa, by a first fluid-pressure-operable ram suitably connected to the sprag and to the cantilever.

3. A support as claimed in claim 2, in which said cantilever is extendible and retractable with respect to a mine-roof-engageable canopy, forming part of said main portion, by a second fluid-pressure-operable ram housed within said canopy.

4. A support as claimed in claim 3, in which said means for advancing said support comprises a third fluid-pressure-operable ram one element of which is connected to a mine-floor-engaging beam, forming another part of said main portion, and the other element of which is connected to one end of a relay bar, the other end of said relay bar being connected to conveyor equipment associated with the support and running along the length of said face.

5. A support as claimed in claim 4, in which said first, second and third rams form part of a fluid-pressure control circuit for said support, suitable control valve means being provided which are so operable that for advance of said support said first ram is hydraulically locked in an extended condition thereby to maintain said sprag in engagement with said face, said second ram is placed in communication with return or with low pressure, and said third ram is operable to move said main portion towards said face.

6. A support as claimed in claim 4, in which said support includes a fluid-pressure-operable capsule operable to tilt said cantilever, when in an extended or extending condition, into load-supporting engagement with the mine roof.

7. A support as claimed in claim 6, in which said canopy is supported from said mine-floor-engaging beam by a plurality of fluid-pressure-operable telescopic props.

8. A support system, suitable for use in mines in association with conveyor equipment running along a mineral face, including a series of self-advancing supports arranged in side-by-side relationship along the face and each support including a mine-floor-engaging beam, fluid-pressure-operable prop means mounted on said beam and supporting a roof-engaging canopy, a cantilever which is extendible and retractable with respect to the canopy, a sprag engageable with said face and so mounted on said cantilever as to be extendible and retractable with respect thereto, and an advancing ram connected between the support and the conveyor equipment for advancing the support with respect to said face, said system also including a source of fluid pressure, a fluid-pressure-operable ram for operating said sprag, a fluid-pressure-operable ram for operating said cantilever, and control valve means in communication with said source and in fluid circuit with said rams and said prop means, said control valve means being so operable that with said prop means released and thus said canopy released from engagement with said roof and with the advancing ram then energised for advance of the support towards said face the ram associated with said cantilever is so open to return or to low pressure as to offer substantially no resistance to operation of said advancing ram, while the ram associated with said sprag is so energised as to maintain the sprag in an extended, mineral-face-engaging, condition.

* * * * *